United States Patent [19]

Lochridge

[11] Patent Number: 5,074,221

[45] Date of Patent: Dec. 24, 1991

[54] LIFT MECHANISM FOR TILTABLE WORKSURFACE

[76] Inventor: Edwin P. Lochridge, 452 Ridgewood Rd., Atlanta, Ga. 30307

[21] Appl. No.: 522,886

[22] Filed: May 14, 1990

[51] Int. Cl.[5] ..... A47B 3/00

[52] U.S. Cl. ..... 108/6; 248/454

[58] Field of Search ..... 108/6, 7, 9, 8, 1; 248/421, 420, 454, 457, 371, 677

[56] References Cited

U.S. PATENT DOCUMENTS

| | | | |
|---|---|---|---|
| 206,393 | 7/1870 | Ellinger | 108/8 X |
| 744,888 | 11/1903 | Widman et al. . | |
| 1,171,523 | 2/1916 | Kuhn . | |
| 1,293,246 | 2/1919 | Thompson . | |
| 1,293,952 | 2/1919 | Shirley . | |
| 1,568,356 | 1/1926 | Vumbaca . | |
| 1,829,288 | 10/1931 | May . | |
| 1,837,826 | 12/1931 | Mitchell et al. . | |
| 1,921,489 | 8/1933 | Stein . | |
| 2,461,421 | 2/1949 | Jacobus | 248/454 X |
| 2,829,935 | 4/1958 | Colleau . | |
| 2,844,908 | 7/1958 | Moore . | |
| 3,406,933 | 10/1968 | Wait et al. | 108/8 X |
| 3,492,952 | 2/1970 | Yourist . | |
| 3,605,650 | 9/1971 | Hebel et al. . | |
| 4,047,774 | 9/1977 | Hanning . | |
| 4,474,115 | 10/1984 | Carlton | 108/9 X |
| 4,539,913 | 9/1985 | Marchant | 108/8 X |
| 4,561,619 | 12/1985 | Robillard et al. . | |
| 4,646,655 | 3/1987 | Robolin . | |
| 4,781,126 | 11/1988 | Lochridge | 108/6 |

FOREIGN PATENT DOCUMENTS

| | | | |
|---|---|---|---|
| 255150 | 5/1912 | Fed. Rep. of Germany | 248/454 |
| 501242 | 9/1927 | Fed. Rep. of Germany | 248/457 |
| 398262 | 6/1909 | France . | |
| 1222445 | 6/1960 | France | 248/457 |
| 1570581 | 6/1969 | France | 248/454 |
| 346673 | 7/1960 | Switzerland . | |

*Primary Examiner*—Jose V. Chen

*Attorney, Agent, or Firm*—Wegner, Cantor, Mueller & Player

[57] ABSTRACT

A lift device for adjusting the angular position of a worksurface such as a desk top lying thereon includes a glide sheet (103) upon which the edges of hinged fulcrum plates (100) rest. Protruding pivot pins (120) abut against the edges of the plates and are moved in curved guide slots (131) by means of a lift mechanism (1). The mechanism includes scissors arms (110) which move in accordion-like fashion by operating a lever arm (145). A translation bar (150) interconnects the scissors arms and the lever arm (145). A locking mechanism (160) actuable by pressure-release of a handle (142) may be provided to latch the lever arm in the desired position. The mechanism may be conveniently contained in a housing (9), to provide a drop-in assembly (5) for installation in a desk top or worksurface support system. As an alternative to the manually-operated lever arm, an electric motor (180) may be provided to actuate the scissors arms (110).

17 Claims, 3 Drawing Sheets

LIFT MECHANISM FOR TILTABLE WORKSURFACE

BACKGROUND OF THE INVENTION

My invention relates to a mechanism for adjusting the angle of the worksurface of a desk or workstation. This invention also relates to an adjustable desk-top assembly having an improved lift mechanism for facilitating adjustment of the angle of the worksurface of the desk or workstation in accordance with the desires of the user.

Desks have evolved from simple table-like structures into some fairly complex designs. One example of such a design is illustrated in U.S. Pat. No. 4,646,655 to Robolin for a Data Processing Work Station. In the assembly of Robolin, a tubular framework is provided having multiple shelves for holding various components of a data processing system. Another assembly is described in U.S. Pat. No. 4,561,619 to Robillard et al. for a Movable CRT Pedestal. This assembly involves the use of a laterally movable support for a video display monitor. The support includes telescoping arms for adjusting the distance of the monitor from the user.

Other desk designs involve the use of slanted and/or wraparound worksurfaces. Such designs are exemplified by U.S. Pat. No. 744,888 to Widman et al. This patent discloses an office desk with a slanted worksurface having a recessed central portion so that the desk wraps around the user. Another example is found in U.S. Pat. No. 1,293,952 to Shirley describing a desk featuring a wrap-around design with storage compartments.

Many of the known designs are disadvantageously limited to specifically defined applications. For example, a desk designed for a data processing station may lack a writing surface. Other desk assemblies are unable to accommodate a computer system, or do not facilitate convenient use of a keyboard without difficulty.

In order to overcome the drawbacks of known desk assemblies, an adjustable desk-top assembly has been developed which can support a variety of functions and can be supported by a variety of means. Such a desk-top assembly is described in U.S. Pat. No. 4,781,126 to Lochridge, the disclosure of which is herein incorporated by reference. The adjustable desk top can serve as a data processing station with storage capabilities, as well as a writing or drawing worksurface which is convenient and comfortable to the user. The assembly described in U.S. Pat. No. 4,781,126 provides an exemplary separate supporting desk top wherein the worksurface is adjustable to assume different slopes to suit the user.

FIG. 1 of the present disclosure illustrates a desk-top assembly 10 of U.S. Pat. No. 4,781,126, having a desk pedestal 12 a base or lower panel 16 and an upper panel 22. The assembly 10 shown in FIG. 1 includes one type of mechanism for adjusting the position of desk top 28 about a pivot point. A securing means 35 having a bar 36 secured by brackets 38 near the front edge of the desk-top worksurface 28 provides the pivot point. The ends of the bar 36 are secured within the assembly via apertures or slots formed near the bottom portion of side panels 26. A spacer block 42 is disposed beneath the back edge of surface 28 for adjusting its elevation relative to the base member 16. By adjusting the position of the spacer 42 forwardly or rearwardly beneath the back edge of surface 28, the slope imparted to the worksurface is varied from about zero to 45 degrees inclination.

A second type of lift mechanism for adjusting the tilt of a desk top is shown in FIG. 2. In the assembly of FIG. 2, a transverse support bar 52 is secured to extend between the right and left sides of base member 16. Extending upwardly through the bar 52 is at least one jack screw 54 disposed for axial movement. A bracket 56 is secured to the underside of the bar 52 for securing a pulley 58. Each jack screw 54 is threadedly engaged by a pulley 58, with the pulleys being interconnected through a cable 60. Cable 60 extends around each pulley 58 and around an additional pulley operatively connected to a motor 64 for moving the arrangement. The motor 64, connected via power cord 68 to a power source, is mounted inside a compartment on base 16 and has a shaft 66 extending downwardly therefrom to fixedly engage and turn the additional pulley. This in turn causes each pulley 58 to rotate, thereby moving each jack screw 54 in a vertical direction. The vertical movement of the threaded jack screw 54 serves to adjust the slope of the surface 28 to the desired level.

While the above-describe mechanisms for adjusting a desk top adequately serve their purpose, in using the first mechanism the user may be required to remove objects from the desk top, and then move the spacer beneath the desk top to adjust the tilt. The second lift mechanism requires the use of pulleys and cable, which may suffer from wear after extended use.

Other lift mechanisms for adjustable table tops are known in the art. U.S. Pat. No. 1,171,523 to Kuhn discloses a Drafting Table adjusted by means including hinged arms which swing upwardly and downwardly. U.S. Pat. No. 1,293,246 to Thompson describes an adjustable desk or table having guide bars hingedly connected thereto. U.S. Pat. No. 1,829,288 to May relates to a Drafting Table having means for adjusting the inclination thereof, which include pivotally connected links having a slot and a clamping bolt. U.S. Pat. No. 1,837,826 to Mitchell et al. describes a Vertically and Angularly Adjustable Table having two systems of crossed links arranged in parallel vertical planes extending from front to rear of the table. U.S. Pat. No. 1,921,489 to Stein discloses a Cutting Table pivotally mounted, having means for locking the table in a horizontal position. U.S. Pat. No. 2,844,908 to Moore describes an Adjustable Drawing Easel having a pair of extensible elevating arms pivotally adjustable via carriage bolts engaged in slots. U.S. Pat. No. 3,492,952 to Yourist discloses a Portable Drawing Board having pivotable frames hingedly connected to each other.

A more recent type of adjustment mechanism is illustrated in U.S. Pat. No. 3,605,650 to Hebel et al., disclosing a tiltable Drafting Table having pivot pins which extend from the sides of the table top and engage a frame. The frame includes support sleeves for engaging the pivot pins, and arrestor guides may be provided for locking the table top in position. Another recent mechanism is shown in U.S. Pat. No. 4,474,115 to Carlton, describing a Tilting Table wherein an adjusting knob actuates a threaded horizontal shaft which actuates a linkage arrangement to adjust the position of a table top.

While the prior art contains various types of lift mechanisms for raising and lowering a table or desk top, the mechanisms suffer many disadvantages. For example, many of the mechanisms are bulky, cumbersome and inconvenient. Some prior art mechanisms cannot operate smoothly when bearing a significant amount of weight, while others cannot support a significant load, such as 350 lbs., throughout the various angles of inclination. Other mechanisms are subject to wear and weakening upon repeated use. Further, various prior art mechanisms suffer from the drawback of not being conveniently and reliably lockable. Additionally, some of the adjustable worksurfaces of the prior art are expensive to produce, while others are difficult to install and/or service.

Accordingly, a reliable lift mechanism is desired having advantageous features for conveniently and effectively adjusting the angular position of a worksurface, desk top, table top or other surface in a practical manner.

SUMMARY OF THE INVENTION

An object of this invention is to provide a lift mechanism for conveniently adjusting the angular position of a worksurface or other surface.

Another object of the present invention is to provide a worksurface tilt-adjustment mechanism which will support approximately 350 pounds throughout its span of tilted positions.

A further object is to provide a self-contained worksurface tilt adjustment assembly which is suitable to be conveniently installed into a desk top or worksurface support system or the like.

Another object of this invention is to provide a mechanism for tilting a worksurface which facilitates smooth and quiet operation while the worksurface is bearing a load.

An additional object is to provide a mechanism which can be practically manufactured at relatively low cost.

A further object of the invention is to provide a compact lift mechanism, with few component parts.

In accordance with the invention, a lift device for adjusting the position of a worksurface comprises: a glide sheet having a top surface and a bottom surface; a hinged fulcrum lift having sliding edges positioned on the top surface of the glide sheet, the hinged fulcrum lift including a pair of side-by-side fulcrum plates, and a hinge pivotally connecting the fulcrum plates together to form a fulcrum line between the edges; and adjustment means for raising and lowering the vertical elevation of the fulcrum line.

Preferably, the sliding edges of the hinged fulcrum lift have widened ends, and glide strips are provided on the sliding edges of the hinged fulcrum lift. The hinged fulcrum lift preferably includes a wear surface on the hinge so that a desk top may readily slide thereon.

In a preferred embodiment, the glide sheet has a retention slot therein, and the hinged fulcrum includes an extended guide which slides within the retention slot when the adjustment means is operated to vertically raise or lower the hinged fulcrum line. The retention slot and guide arrangement prevents the hinged fulcrum lift from falling out of place, e.g. when the unit is turned on its side or upside down. The arrangement also serves to aid alignment of the fulcrum as it is adjusted.

The device according to the invention may be operated manually or electrically, or by other suitable power sources. Thus, the device may be conveniently operable by means of an electric motor operatively connected to the adjustment means.

A preferred adjustment means according to the invention comprises: scissors arms beneath the bottom surface of the glide sheet, the scissors arms including a first long bar and a second long bar, and a pivoting fastener passing through the centers of the first and second long bars and pivotally connecting the first and second long bars to the glide sheet; four pivoting abutment pins extending through four arcuate guide slots in the glide sheet, the arcuate guide slots equidistantly spaced from the central pivoting fastener, with one pivoting abutment pin fastened through each end of the first and second long bars and protruding upwardly through an arcuate guide slot, wherein each sliding edge of the hinged fulcrum lift abuts against two pivoting abutment pins; and actuating means operatively connected to the scissors arms for pivoting them around the pivoting fastener to move the four pivoting abutment pins in their corresponding arcuate slots.

A preferred lift device advantageously includes a looking means for locking the position of the actuating means.

The above-mentioned and other objects and advantages of the invention will become apparent from the following detailed description with reference to the accompanying drawings.

BRIEF DESCRIPTION OF THE DRAWINGS

FIG. 4 is a side view of the mechanism of the invention housed in a drop-in assembly, installed in a desk compartment, workstation or the like.

DESCRIPTION OF THE PREFERRED EMBODIMENTS

Figure 1:
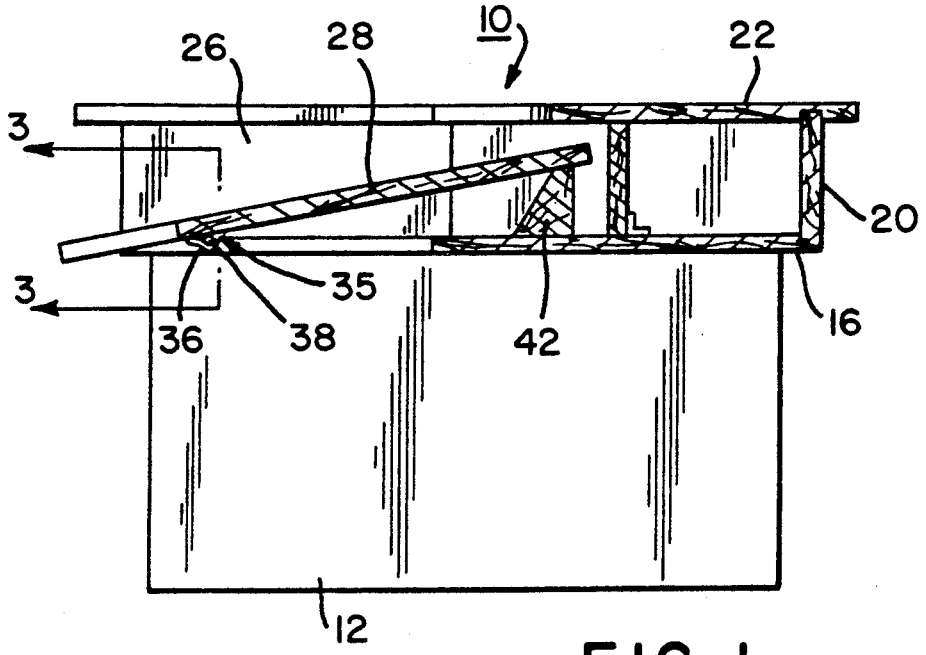
FIG. 1 PRIOR ART
FIG. 1 a prior art adjustable desk-top assembly and a known mechanism for adjusting the slope of the desk top.
Figure 2:
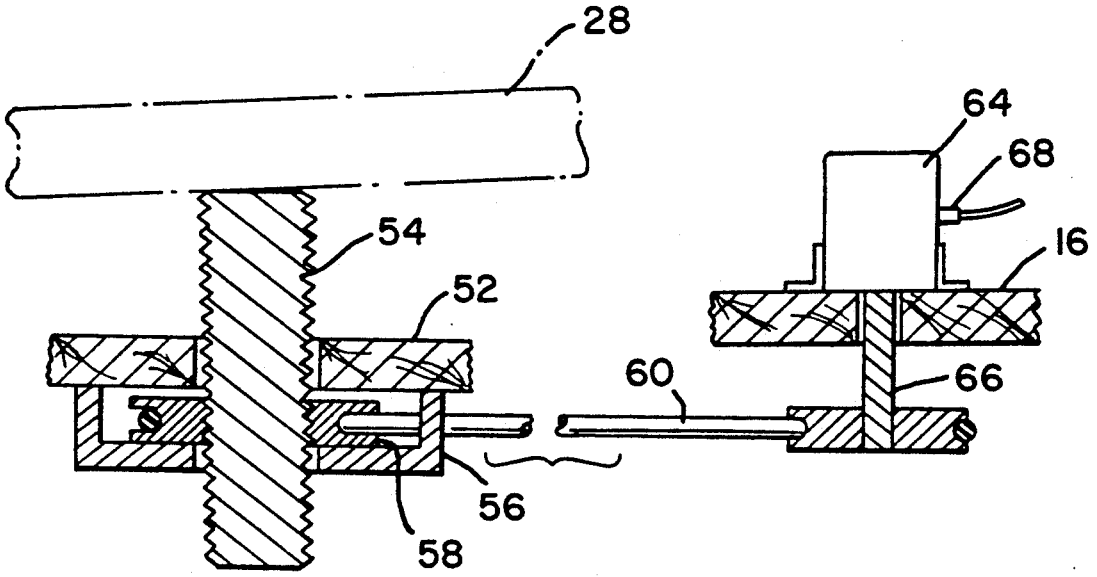
FIG. 2 PRIOR ART
FIG. 2 illustrates another prior art lift mechanism for moving the position of a worksurface.
Figure 3:
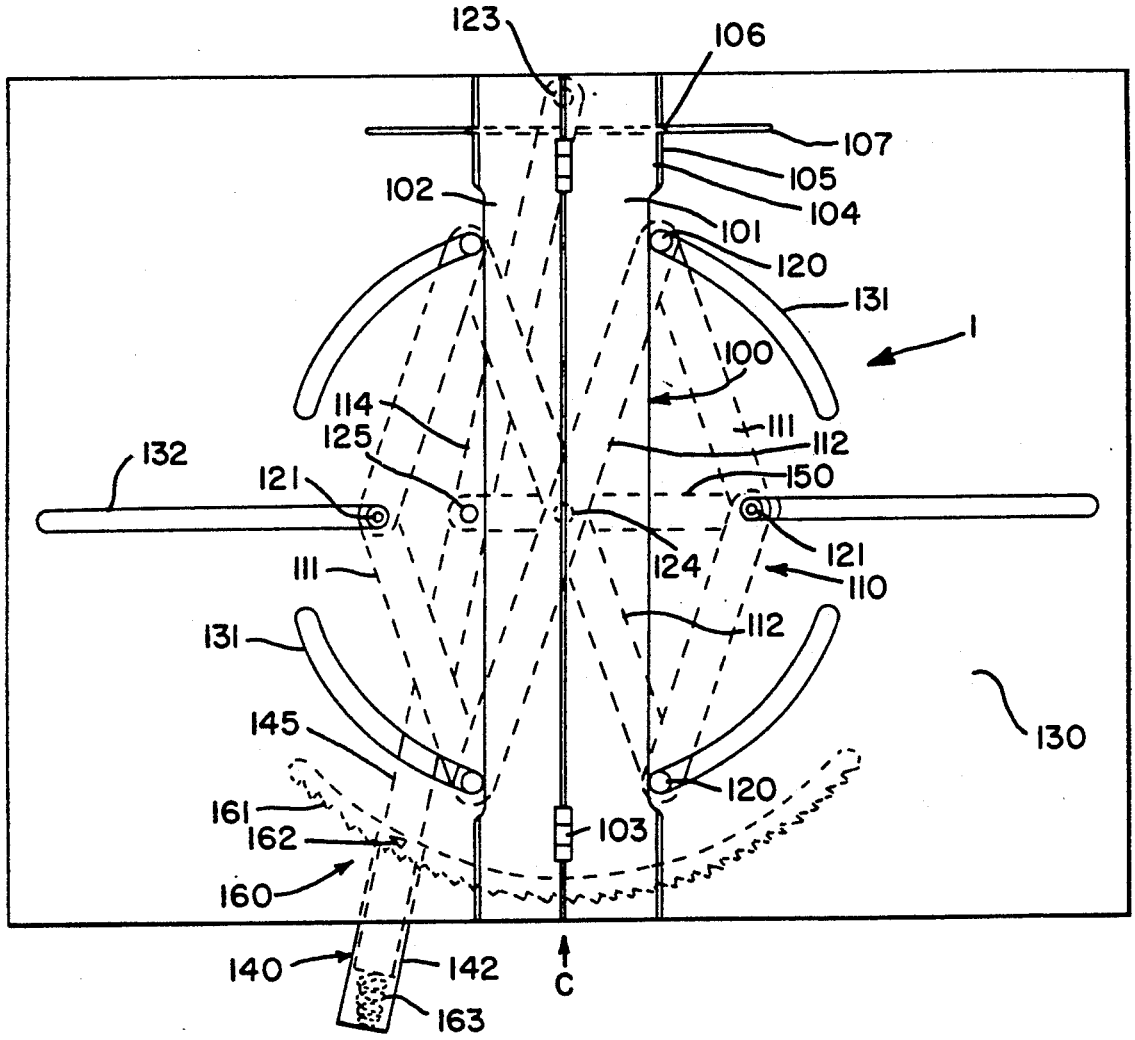
FIG. 3 is a plan view of an adjustable lift mechanism according to one embodiment of the invention.

As schematically shown in FIG. 3, the mechanism 1 of the invention includes scissors arms 110 mounted beneath glide sheet 130 upon which hinged lift or fulcrum 100 rides. The elements hidden under sheet 130 are shown in phantom lines. The scissors arms 110 are operated using a lever arm 140 which thereby adjusts the vertical height of the lift 100.

The scissors arms 110 include at least two long flat bars 112, preferably four short flat bars 111 and two long flat bars 112. Exemplary lengths for the short and long bars are about 4 inches and 8 inches, respectively. The two long bars 112 are pivotally fastened to each other and sheet 130 via a central pivoting fastener 124, which may include a screw or the like. The long bars 112 are pivotally connected to the short bars 111 via pivoting abutment pins 120, e.g., nuts and bolts or the like, which extend through a curved guide slot 131 in the sheet 130.

The scissors arms 110 are located under sheet 130 and are secured against rotation around central attachment point 124 by means of guide fasteners 121 which ride in straight guide slots 132. Pairs of short bars 111 are pivotally connected together by the fasteners 121. The fasteners 121 can be pivoting adjustment pins, bolts secured by nuts, screws, etc.

To actuate the scissors arms, force is applied to a pivot point, e.g. 120 or 121. In one embodiment, an electric motor or other power means may be operatively connected to the scissors arms via a fastener 121 to actuate the mechanism.

In an alternative embodiment shown in FIG. 3, a translation bar 150 operatively connects the scissors arms 110 to the lever arm 140. The translation bar 150 is about 6 inches long in the exemplary embodiment. As shown in FIG. 3, the translation bar 150 is pivotally connected to the lever arm 140 by means of a fastener 125 such as a screw.

The lever arm 140 includes a lever bar 145, approximately 18 inches long in the exemplary embodiment. The lever arm 140 is pivotally mounted beneath sheet 130 by means of a pivoting fastener 123. For example, the pivoting fastener 123 may include a screw bolt, one or more cylindrical spacers and a nut (see FIG. 5), with the sheet 130 sandwiched between the head of the bolt on top and the spacers below, and the lever bar 145 lying between the spacers and the nut. The lever arm 140 preferably includes a handle grip 142.

Figure 4:
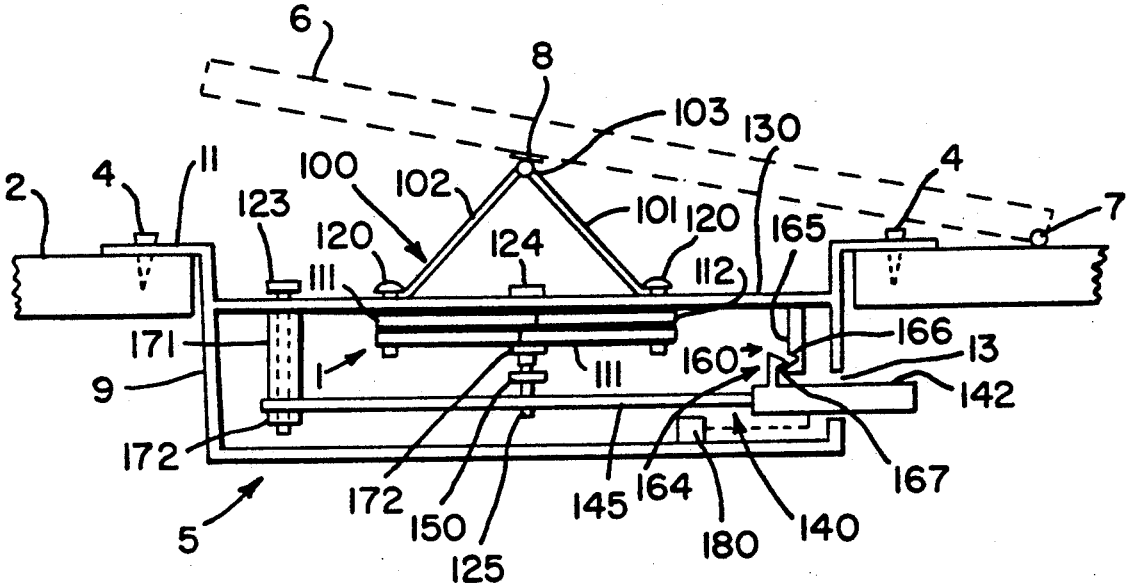

Positioned between and abutting against the two pairs of pivoting abutment pins 120 is the hinged lift 100. The lift can be removably located along fulcrum line C, or the line perpendicular thereto (i.e., in a line running through straight guide slots 132) as shown in FIG. 4. Thus, the desk top can be suitably located to meet the needs of the user.

The hinged fulcrum lift 100 includes a pair of elongated fulcrum plates 101 and 102, which are connected together by one or more hinges 103. The plates 101, 102 of the exemplary embodiment are approximately 4 inches wide. Other widths can be used for plates 101 and 102, with the maximum height of the fulcrum lift 100 at hinge point 103 proportionately increasing with the width of the plates 101, 102 in the device. Although a single hinged structure has been illustrated, a plurality of separate hinged structures could be used instead.

Preferably, each plate has widened ends 104 to help distribute the load to the ends of plates 101, 102 and to optimize the contact with parts 120. The plates 101, 102 also desirably have glide strips 105 made of plastic or the like, to provide for smooth gliding of the edges of the fulcrum plates 101, 102 upon the sheet 130 and to diminish frictional wear. An additional preferred feature is the provision of extended guides 106 connected to the plates 101, 102, which fit within retention slots 107 in glide sheet 130. Although the guides 106 and slots 107 have been shown associated with the same end of the fulcrum lift 100, a slot 107 and guide 106 arrangement could be associated with the opposite ends or alternate (counterposing) ends of the lift 100.

In accordance with a preferred embodiment of the invention, a latching or locking mechanism 160 is provided to secure the lever arm 140 in the desired position. One embodiment of a ratchet-type locking mechanism is illustrated in FIG. 3.

The locking mechanism includes a ratchet guide 161, which may be composed of a toothed guide mounted on the underside of sheet 130 as shown in FIG. 3. A pawl-like ratchet engagement means 162 operatively connected to the lever arm 140 cooperates with the ratchet guide 161 to lock the position of the lever bar 145. In the embodiment of FIG. 3, the engagement means 162 is attached to the biased handle 142 and lies against the upper surface of the lever bar 145. A bias means 163 such as a spring is provided between the 1®v®r bar 145 and grip 142 to bias the engagement means 162 into interlocking engagement with the ratchet guide 161 upon release of pressure against the handle 142.

In operation of the embodiment of the mechanism shown in FIG. 3, the lever arm 140 is moved left or right to adjust the lift 100 and change the angle of inclination of a worksurface resting upon the fulcrum line C. To unlock the lever arm 140, the handle grip 142 is grasped and pushed in the direction of the pivot 123 to compress spring bias 163 and release the engagement means 162 from engagement with the ratchet guide 161 teeth. The lever arm 140 is then moved left or right to respectively raise or lower the lift 100 to the desired position, and the handle 142 is released to bias the engagement means 162 into a locking position in the ratchet guide 161.

By pivoting the lever arm 140 to the left in FIG. 3, the lever bar 145 pulls the translation bar 150 to the left, which operates the scissors arms 110 in an accordion-like manner to draw guide fasteners 121 toward each other and the abutment pins 120 toward center line C running between plates 101 and 102. This in turn moves the hinged plates 101, 102 to glide on the sheet 130 toward each other, and raises the fulcrum center line C upward thereby lifting a worksurface lying thereon. To lower the center line C, the lever arm 140 is moved to the right in a similar operation. The use of the scissors arms in conjunction with fulcrum plates of similar width, provides the mechanism with a steady rate of rise or fall for the fulcrum center line C.

FIG. 4 shows a side view of another embodiment of mechanism 1 according to the invention, housed in a compact dropin assembly 5 for easy installation in a recess 3 formed in a desk-top or worksurface support system 2 or the like. In the embodiment depicted in FIG. 4, the lift 100 lies between opposing pairs of abutment pins 120 along a line perpendicular to the line C as shown in FIG. 3.

The mechanism 1 is mounted in a housing 9 which is mountable via flanges 11 to a desk pedestal or the like 2 by means of fasteners 4 such as screws. The handle 142 on the lever bar 145 passes through a slot or aperture 13 in the housing, so that the lever arm 140 can be conveniently operated to adjust the inclination of the lift plates 101 and 102. Thus, when a desk top or surface 6 is situated on top of the hinged lift 100, adjustment of the lever arm 140 tilts the worksurface 6 around pivot point 7.

As shown in FIG. 4, a friction-reducing wear surface 8 can be affixed or coated on the top surface of hinge means 103, to provide a smooth surface upon which the desk top 6 can slide when the tilt is adjusted. The material for the wear surface 8 is selected based on the composition of the desk or table top 6, and can be a suitable plastic or the like.

Also illustrated in FIG. 4 is the use of a cylindrical spacer 171 mounted on pivot 123, to appropriately locate the lever arm 145 in the housing 9. The use of nuts 172 to secure pivoting fasteners and the like is also shown in FIG. 4.

FIG. 4 also illustrates a variant of locking mechanism 160. In this embodiment the latching mechanism 160 includes a locking guide 165 which has a series of closely-spaced depressions or apertures 166 defined therein. A biased handle 142 is provided in a manner similar to the embodiment shown in FIG. 3. The handle carries thereon a detent extension 164 having a detent 167 which interlockingly engages the depressions 166 in locking guide 165 when pressure on the biased grip 142 is released.

The locking mechanism 160 of FIG. 4 is operated in a manner analogous to that of FIG. 3. That is, the grip 142 is grasped and pushed toward the left in FIG. 4 to compress the spring and free the detent 167 from engagement in the locking guide 165. While maintaining pressure on the handle 142, the lever arm 140 is then moved to the desired position. Then the handle 142 is released to catch the detent 167 in a depression 166, and lock the lever arm 140 in place.

In still another embodiment of the locking mechanism, the lower surface of the housing 9 can be provided with apertures or depressions arranged as an arc. In this case, the handle 142 is provided with a detent which is urged into engagement with the aperture or depression to lock the lever arm 140 against movement. To move the lever arm 140, the handle 142 is twisted, i.e. rotated around an axis lying along the length of the lever arm, to release the detent from the aperture or depression. The lever arm 140 is then moved to the desired position and the handle released, whereby the detent is urged into engagement with another aperture or depression, again locking the lever arm 140 against movement.

Figure 5:
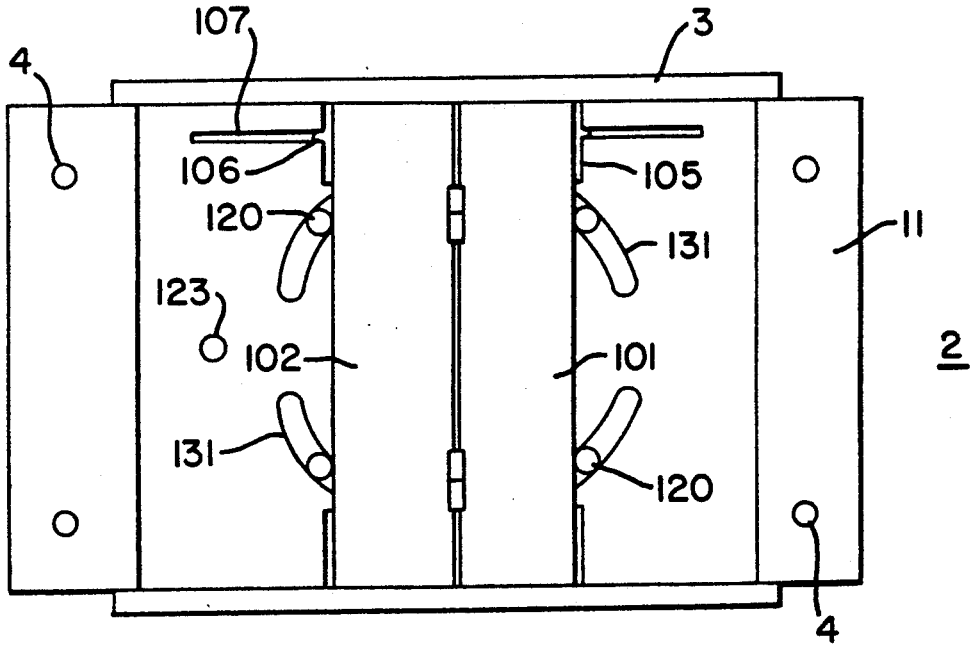
FIG. 5 is a plan view of the drop-in assembly of FIG. 4.

A plan view of the drop-in assembly 5 secured in a workstation recess 3 is schematically illustrated in FIG. 5. As an alternative to the embodiment shown in FIG. 3, extended guides 106 are connected to the glide strips 105 and slide within the retention slots 107 in glide sheet 130.

The present invention is amenable to various modifications within the purview of the artisan. For instance, in addition to the specific embodiments of the lift device disclosed herein, various other types of mechanisms 160 for reliably locking the lever arm 140 in the desired location can be used with the general mechanism 1.

For example, a ratchet guide 161, locking guide 165 or the like may be used on the opposite side of a pawl-like element 162 or detent 167, with the interlocking features of the engagement element 162 or detent 167 facing in the opposite direction of the embodiments shown in the Figures, and the handle 142 also biased in the opposite direction in relation to the lever bar 145. As an alternative to a biased handle, a locking hand crank or the like can be used to adjust the lever arm 140 of the embodiment shown in FIG. 3. Additionally, the scissors arms 110 may be electrically operable via functional connection to an electric motor. For example, the lever arm 140 and locking mechanism can be made to be electrically operable, driven by an electric motor 180 as schematically shown in FIG. 4. Alternatively, the electric motor 180 may directly drive the movement of the scissors arms 110, with the lever arm and translation bar removed altogether.

Other suitable automatically-locking assemblies actuable upon pressure-release of lever handle 142 are contemplated to be usable with the lift mechanism 1 of the invention, which meet the preferred criteria of requiring an overt act to unlatch and move the lever arm 140, being made of durable and reliable parts, providing smooth and quiet operation upon adjustment, and being able to support a substantial load, e.g., 350 lbs., throughout operation.

I claim:

1. A lift device for adjusting the angular position of a worksurface, comprising a glide sheet having a top surface and a bottom surface; a hinged fulcrum lift having sliding edges positioned on the top surface of said glide sheet, said hinged fulcrum lift including a pair of side-by-side fulcrum plates, and a hinge pivotally connecting said fulcrum plates together to form a fulcrum line between said edges; and adjustment means for raising and lowering the vertical elevation of said fulcrum line, wherein said adjustment means comprises:

scissors arms beneath the bottom surface of said glide sheet, said scissors arms including a first long bar and a second long bar, and a pivoting fastener passing through the centers of said first and second long bars and pivotally connecting said first and second long bars to said glide sheet;

four pivoting abutment pins extending through four arcuate guide slots in said glide sheet, said arcuate guide slots equidistantly spaced from said pivoting fastener, with one said pivoting abutment pin fastened through each end of said first and second long bars and protruding upwardly through one said arcuate guide slot, wherein each said sliding edge of the hinged fulcrum lift abuts against two said pivoting abutment pins; and actuating means operatively connected to said scissors arm for pivoting said scissors arm around said pivoting fastener to move said four pivoting abutment pins in said four arcuate slots.

2. A lift device according to claim 1, wherein each of the sliding edges of said hinged fulcrum lift has widened ends in contact with the glide sheet and an intermediate portion not in contact with the glide sheet.

3. A lift device according to claim 1, further comprising glide strips on said sliding edges of the hinged fulcrum lift.

4. A lift device according to claim 1, wherein the glide sheet has a retention slot therein, and said hinged fulcrum includes an extended guide which slidingly fits within said retention slot when the adjustment means is operated to vertically raise or lower the hinged fulcrum line.

5. A lift device according to claim 1, further comprising an electric motor operatively connected to said adjustment means.

6. A lift device according to claim 1, wherein said hinged fulcrum lift further includes a wear surface on said hinge.

7. A lift device according to claim 1, wherein said adjustment means further comprises locking means for locking the position of said actuating means.

8. A lift device according to claim 1, wherein said guide sheet has two straight guide slots equidistantly spaced from said pivoting fastener along a line passing through said pivoting fastener between two pairs of said arcuate guide slots, said scissors arms further including four short bars, with a first end of each said short bar pivotally connected to one said pivoting abutment pin, and a guide fastener in each said straight guide slot pivotally connecting a second end of each said short bar to a second end of another short bar.

9. A lift device according to claim 8, wherein said actuating means comprises a lever arm operatively connected to one said guide fastener.

10. A lift device according to claim 8, wherein said actuating means comprises a lever arm having a pivoting end and a handle end, and said adjustment means further comprises:

a translation bar pivotally connected beneath said scissors arms at a first end to one said guide fastener;

a first pivoting connector fastening a second end of said translation bar to said lever arm at a point between the pivot end and the handle end; and a second pivoting connector fastening said lever arm at the pivot end to said glide sheet.

11. A lift device according to claim 10, wherein said adjustment means further comprises locking means for locking the position of said lever arm.

12. A lift device according to claim 11, wherein said locking means includes a pressure-release locking mechanism.

13. A lift device according to claim 12, said pressure-release locking mechanism including an engagement guide on the bottom surface of said glide sheet, a biased grip on the handle end of said lever arm, and catch means connected to said biased grip, wherein said engagement guide has interlocking means for lockingly engaging said catch means upon release of pressure on said biased grip.

14. A lift device according to claim 1, further comprising a housing enclosing said scissors arms.

15. A lift device according to claim 14, wherein said housing includes flange means for mounting said housing in a worksurface support system.

16. A lift device according to claim 1, further comprising a housing enclosing said scissors arms and means defining an aperture in said housing through which said actuating means passes.

17. A lift device according to claim 1, wherein said actuating means comprises an electric motor.

* * * * *